US006048230A

United States Patent [19]

Kikuchi

[11] Patent Number: 6,048,230

[45] **Date of Patent: *Apr. 11, 2000**

[54] CONTACT AND HIGH-DENSITY CONNECTOR USING THE SAME

[75] Inventor: Kazuya Kikuchi, Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/966,037

[22] Filed: Nov. 7, 1997

[30] Foreign Application Priority Data

Nov. 25, 1996 [JP] Japan ..... 8-313164

[51] Int. Cl.[7] ..... H01R 13/10

[52] U.S. Cl. ..... 439/682; 439/668

[58] Field of Search ..... 439/682, 668, 439/669, 692, 650, 651, 652, 655, 658, 68, 70, 72, 77, 637, 79, 856, 857

[56] References Cited

U.S. PATENT DOCUMENTS 4,453,792 6/1984 Bright et al. ..... 339/64 R
4,867,690 9/1989 Thumma ..... 439/79
5,199,886 4/1993 Patterson ..... 439/79
5,618,187 4/1997 Goto ..... 439/79
5,685,746 11/1997 Maejima ..... 439/845
5,702,257 12/1997 Millhimes ..... 439/72

FOREIGN PATENT DOCUMENTS 62-158772 10/1987 Japan .

*Primary Examiner*—Paula Bradley
*Assistant Examiner*—Ross Gushi
*Attorney, Agent, or Firm*—Young & Thompson

[57] ABSTRACT

In a connector, distal end portions of a pair of elastic tongue pieces are formed with beveling tapered-extension portions such that, when the elastic tongue pieces are displaced substantially perpendicularly to an inserting direction of a rod-like male terminal upon insertion and fitting of the rod-like male terminal between the elastic tongue pieces of a bifoliate female terminal, distal-end outer-side surfaces of the elastic tongue pieces become parallel to an inner wall of a female terminal insertion window with an angle determined by considering an angle of deflection of the elastic tongue pieces. A high-density connector using this contact is also disclosed.

2 Claims, 7 Drawing Sheets

CONTACT AND HIGH-DENSITY CONNECTOR USING THE SAME

BACKGROUND OF THE INVENTION

1. Field of the Invention

The present invention relates to a contact used in connecting boards of a switching unit or the like, and a high-density connector using this contact.

2. Description of the Prior Art

FIG. 1 is a perspective view showing the fitting state of a conventional board-to-board connector. The high-density connector is constituted by a male connector and a female connector. The male connector has a male connector housing 12 and a plurality of male terminals 71 locked in it. The female connector has a female connector housing 11 and a plurality of female terminals 73 having at their distal end portions elastic tongue pieces that respectively come into contact with the individual male terminals 71 to be fitted with them. Reference numeral 74 denotes a columnar L-shaped terminal 74 connected to the corresponding female terminal 73.

Conventionally, as shown in FIG. 6 of Japanese Unexamined Utility Model Publication No. 62-158722, to obtain a female terminal used in board-to-board connection or the like, a pair of elastic tongue pieces 65-1 and 65-2, and an external connection terminal 62 are formed by press-punching an elastic metal plate, and a cylindrical portion and the U-shaped bent portions at the distal ends of the elastic tongue pieces are formed by pressing. Conventionally, this female terminal is inserted and locked in the female terminal insertion window of a synthetic resin connector housing used for board-to-board connection or the like.

FIGS. 2 and 3 are sectional views showing the fitting states of conventional male and female terminals.

As shown in FIG. 3, when inserting the male terminal 71 in a female terminal insertion window 11*a* of the connector housing 11 for the female terminal 73, elastic tongue pieces 72 of the female terminal 73 come into contact with the male terminal 71, and are displaced substantially perpendicularly to the inserting direction of the male terminal 71.

The first problem of the prior art is as follows. When inserting the male terminal 71 in the female terminal insertion window 11*a*, the elastic tongue pieces 72 of the female terminal 73 come into contact with the male terminal 71. Since distal-end outer-side portions 72*a* of the elastic tongue pieces 72 project, they can easily interfere with an female terminal insertion window inner wall 11*b* of the connector housing 11. When designing the connector, a width $W_2$ of the female terminal insertion window 11*a* must be designed widely considering the amount of displacement of the elastic tongue pieces 72.

The second problem is as follows. When the male terminal 71 is to be inserted through an inner wall lid of a male terminal insertion port 11*c* of the connector housing 11, it must be reliably received by the male terminal receiving port between the two distal ends of the pair of elastic tongue pieces 72. If the depth of the male terminal insertion port 11*c* is decreased to downsize the connector, or if the insertion lock positions of the elastic tongue pieces 72 are set shallow to obtain electrical connection sequence, when fitting the male terminal 71 and female terminal 73 with each other, in the prior art, the allowable fluctuation of the distal end of the male terminal 71 becomes large, and a male terminal receiving port width G of the female terminal 73 must be designed large within the range of the predetermined width $W_2$ of the female terminal insertion window 11*a*. This is because each elastic tongue piece 72 is bent into a U-shape and that its distal-end outer-side portion 72*a* projects perpendicularly to the inserting direction of the male terminal 71.

SUMMARY OF THE INVENTION

The present invention has been made in view of the situation described above of the prior art, and has as its object to provide a contact having a female terminal in which, even if the distal end portions of the elastic tongue pieces of the female terminal are displaced by a male terminal, the distal-end outer-side surfaces of the elastic tongue pieces do not interfere with the female terminal insertion window inner wall of the connector housing, and even if the fluctuation of the distal end of the male terminal is larger than that in the conventional case, the male terminal is reliably received by the male terminal receiving port of the female terminals, so that the female terminal can fit with the male terminal, and a high-density connector using this contact.

In order to achieve the above object, according to the first aspect of the present invention, there is provided a contact in which a bifoliate female terminal, having a pair of elastic tongue pieces with distal end portions that come into contact and fit with a rod-like male terminal, a cylindrical portion integrally connected to the elastic tongue pieces, and a columnar L-shaped terminal integrally connected to the cylindrical portion on an end portion of the elastic tongue pieces on a side opposite to the distal end portions thereof to serve for connection with a printed circuit board, is inserted and locked in a female terminal insertion window in a female connector housing made of an insulator and having a male terminal insertion port having a tapered portion at an inlet port thereof and the female terminal insertion window located on a side opposite to the male terminal insertion port and having a larger opening width than that of the male terminal insertion port, wherein the distal end portions of the elastic tongue pieces are formed with beveling tapered-extension portions such that, when the elastic tongue pieces are displaced substantially perpendicularly to an inserting direction of the rod-like male terminal upon insertion and fitting of the rod-like male terminal between the pair of elastic tongue pieces of the bifoliate female terminal, distal-end outer-side surfaces of the elastic tongue pieces become parallel to an inner wall of the female terminal insertion window with an angle determined by considering an angle of deflection of the elastic tongue pieces.

According to the second aspect of the present invention, there is provided a high-density connector wherein the distal end portions of the elastic tongue pieces of the bifoliate female terminal housed and locked in the female terminal insertion window of the female connector housing of the first aspect by press fitting or the like, and a distal-end contact portion of the rod-like male terminal pressed into and locked by an end face of the male connector housing made of the insulator into a box shape are electrically and mechanically connected to each other by fitting a female connector having the female connector housing and the bifoliate female terminal, and a male connector having the male connector housing and the rod-like male terminal, with each other, the female connector and the male connector respectively having terminal portions connected to through holes formed in printed circuit boards by soldering or press fitting of elastic plastic contact portions, thereby allowing the printed circuit boards to be electrically connected to each other.

According to the third aspect of the present invention, there is provided a high-density connector according to the second aspect, wherein when an insertion angle $\theta_1'$ at which the rod-like male terminal is inserted in the female terminal insertion window through the male terminal insertion port of the female connector housing becomes the maximum, a width G' of a male terminal receiving port corresponding to a distance between distal ends of two beveling tapered-extension portions of the pair of elastic tongue pieces satisfies a following correlation:

$$G' = 2\left\{Y_1 - \frac{t \cdot \cos\theta_2}{\tan(\theta_0 + \theta_2)}\right\}\tan\theta_1' + W_1 - \frac{2D \cdot \tan\theta_4}{\cos\theta_1'} + \frac{2t \cdot \sin\theta_2}{\tan(\theta_0 + \theta_2)}$$

where $Y_1$ is a distance from an end face of the female terminal insertion window to the distal ends of the elastic tongue pieces of the female terminal, t is a thickness of the elastic tongue pieces, $W_1$ is a width of the male terminal insertion port, D is a length of a tapered portion of a distal end portion of the rod-like male terminal, X is a depth of the male terminal insertion port, $\theta_0$ is a taper angle of each of the beveling tapered-extension portions of the elastic tongue pieces, $\theta_1'$ is the insertion angle at which the rod-like male terminal is inserted in the female terminal insertion window through the male terminal insertion port, $\theta_2$ is an angle of deflection of each of the distal end portions of the elastic tongue pieces, and $\theta_4$ is a taper angle of the distal end portion of the rod-like male terminal.

In the present invention having the respective aspects described above, the distal ends of the elastic tongue pieces are formed with the beveling tapered-extension portions. The elastic tongue pieces can have a large amount of displacement without causing interference between their distal-end outer-side portions and the inner wall of the connector housing, and the width of the male terminal receiving port of the female terminal can be increased without changing the contact position, so that the maximum allowable fluctuation of the male terminal distal end can be set large. This provides excellent effects as follows.

(1) When increasing the amount of displacement of the elastic tongue pieces in the above manner, it can be done without changing the width of the inner wall of the connector housing. In general, when designing a high-density connector, the width of the inner wall of the connector housing tends to decrease. However, according to the present invention, the width of the inner wall of the connector housing can be decreased while setting the amount of displacement of the elastic tongue pieces to be larger than that in the conventional case. Therefore, spring design and connector housing design can be performed easily.

(2) When increasing the amount of displacement of the elastic tongue pieces in the above manner, it can be done without decreasing the length of the male terminal receiving port portion at the distal end portions of the elastic tongue pieces. As a result, a higher-density connector can be designed easily without setting the fitting condition required when inserting the male terminal to be stricter than that in the conventional case.

The above and many other objects, features and advantages of the present invention will become manifest to those skilled in the art upon making reference to the following detailed description and accompanying drawings in which preferred embodiments incorporating the principles of the present invention are shown by way of illustrative example.

DETAILED DESCRIPTION OF THE PREFERRED EMBODIMENT

The preferred embodiment of the present invention will be described in detail with reference to the accompanying drawings.

Figure 5:
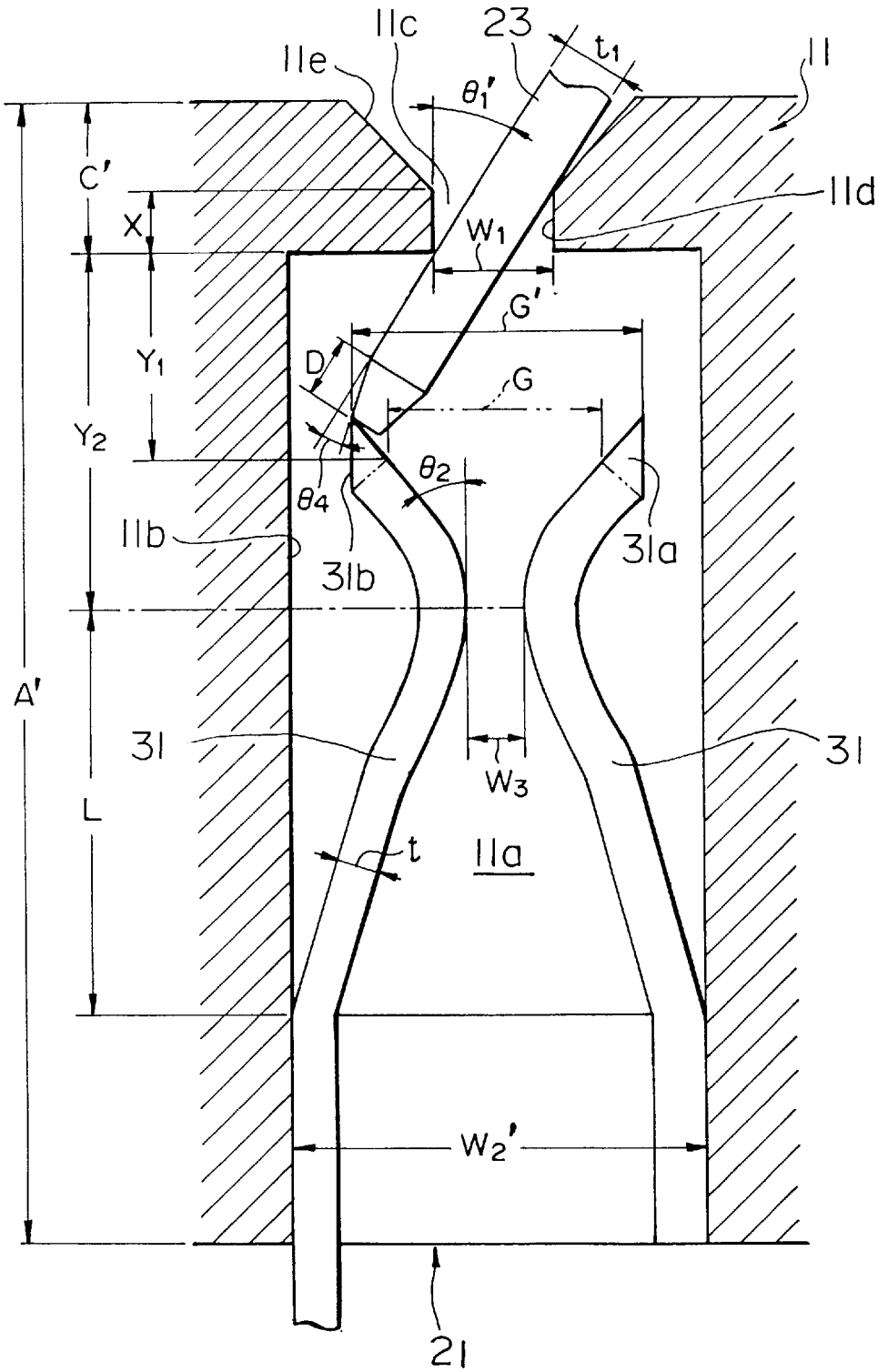
FIGS. 5 and 6 are sectional views showing a state immediately before fitting and a fitting state, respectively, of a male terminal and a female terminal of the present invention.
Figure 6:
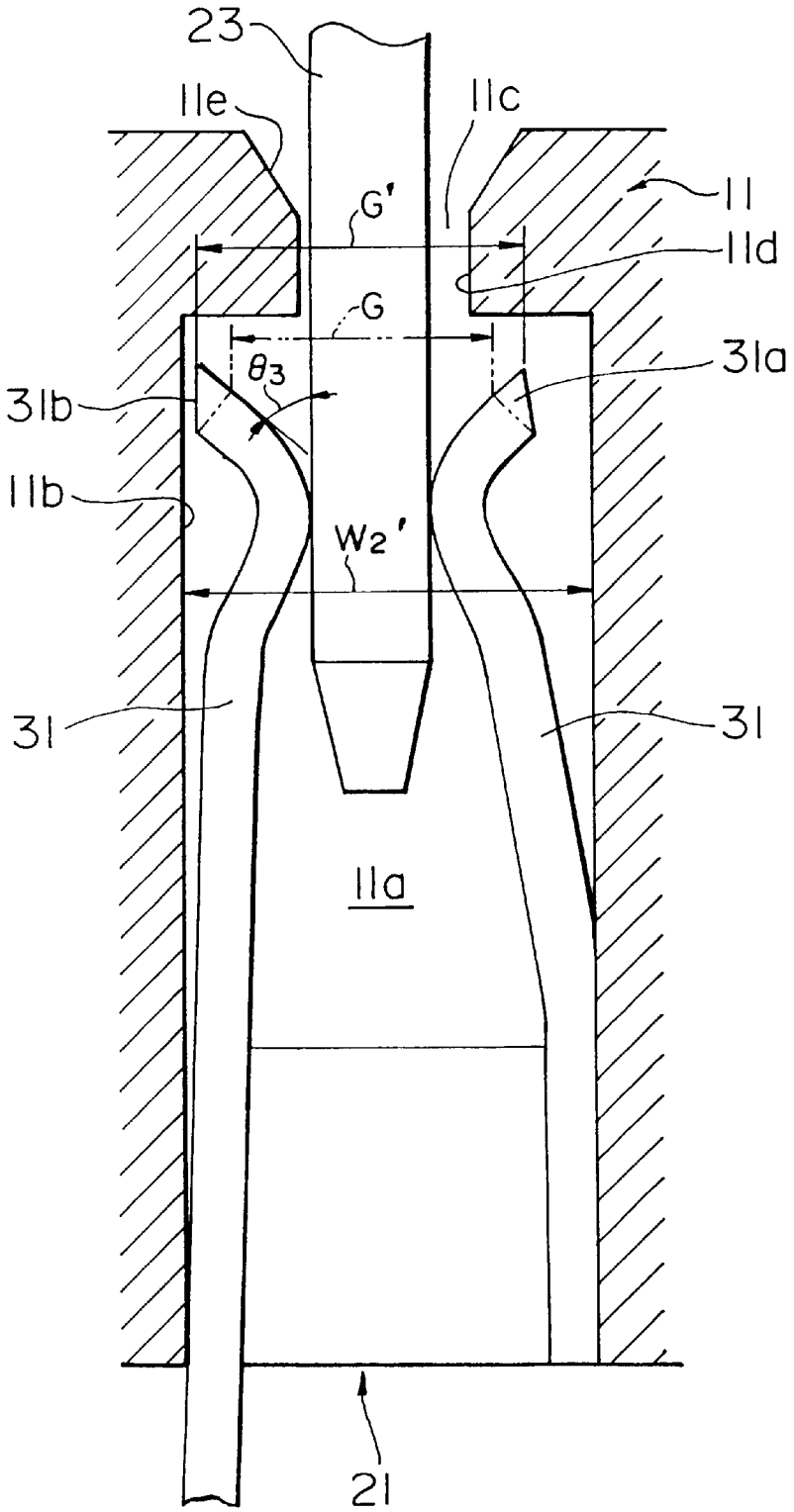

FIGS. 5 and 6 are sectional views showing fitting states of the male terminal and female terminal of a high-density connector according to the present invention.

Figure 1:
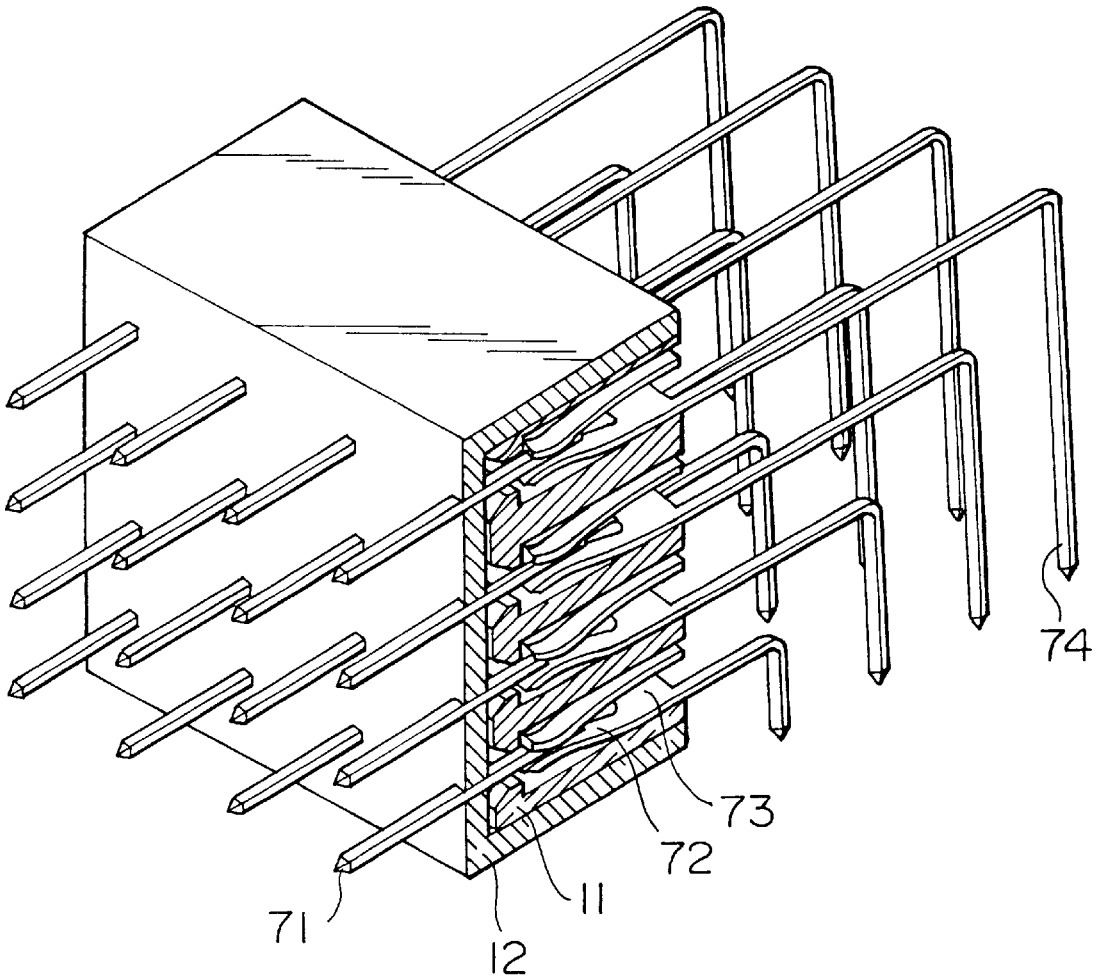
FIG. 1 PRIOR ART
FIG. 1 is a schematic perspective view of a conventional board-to-board connector.
Figure 2:
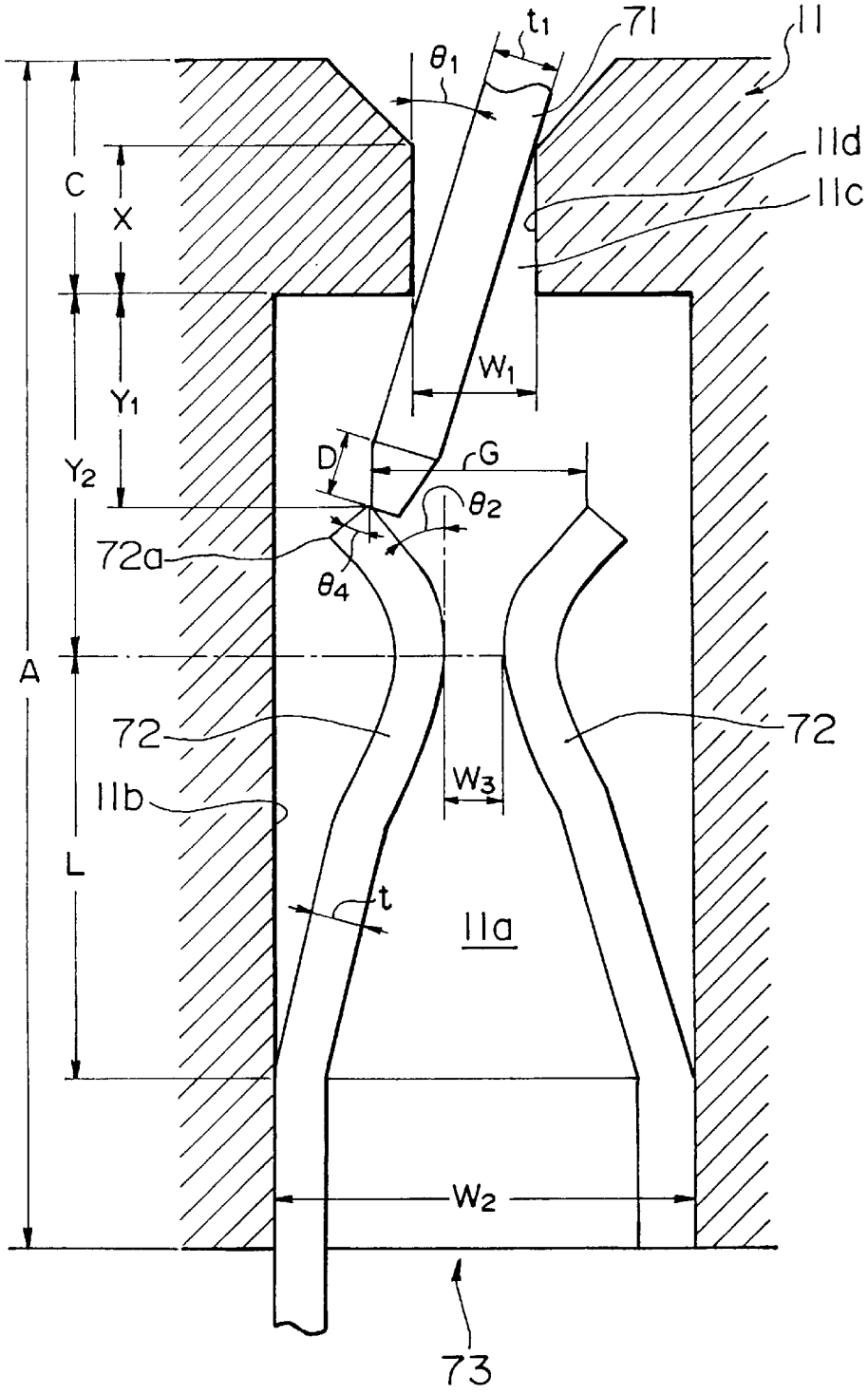
FIG. 2 PRIOR ART
FIG. 2 and FIGS. 3 and 4 are sectional views showing a state immediately before fitting and a fitting state, respectively, of a male terminal and a female terminal in the conventional connector.
Figure 4:
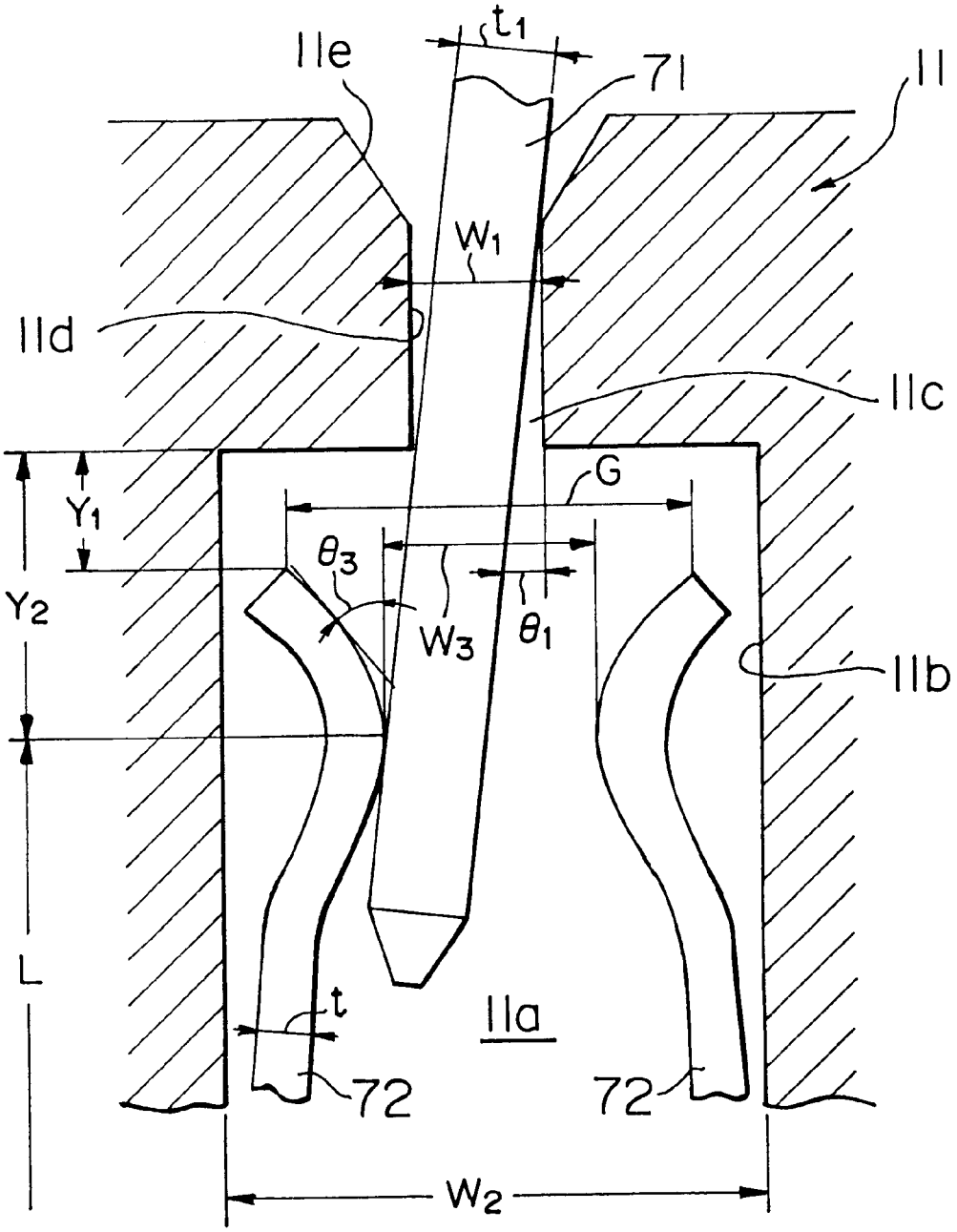
FIG. 4 PRIOR ART

Referring to FIGS. 5 and 6, a female terminal 21 is formed such that distal-end outer-side surfaces 31*b* of beveling tapered-extension portions 31*a* formed at distal end portions of its elastic tongue pieces 31 are parallel to the inserting direction of a rod-like male terminal 23 upon displacement of the elastic tongue pieces 31, considering the angle of deflection of the elastic tongue pieces 31, that a length E of the male terminal receiving port portion of the elastic tongue pieces 31 does not decrease, and that, when the amount of displacement of the elastic tongue pieces 31 is determined, i.e., when a width $W_2$ or $W_2'$ of a female terminal insertion window 11*a* is determined, a width G' of the male terminal receiving port corresponding to the distance between the two distal ends of the pair of elastic tongue pieces 31 according to the present invention shown in FIGS. 5 and 6 becomes larger than a width G of the male terminal receiving port corresponding to the distance between the two distal ends of the pair of conventional elastic tongue pieces 72 shown in FIGS. 2 and 4.

Therefore, when the male terminal 23 is inserted in the female terminal 21, even if the fluctuation of the distal end of the male terminal 23 is large, the male terminal 23 is reliably received by the male terminal receiving port portion between the distal ends of the elastic tongue pieces 31 upon insertion and fitting of the connector. When the distal ends of the elastic tongue pieces 31 are displaced by the male terminal 23, the length E of the male terminal receiving port portion between the distal ends of the elastic tongue pieces 31 does not decrease, and the amount of displacement of the elastic tongue pieces 31 can be made the maximum under the condition that the distal ends of the elastic tongue pieces 31 do not interfere with an inner wall 11*b* of the female terminal insertion window 11*a* of a connector housing 11.

This will be described in more detail.

Figure 7:
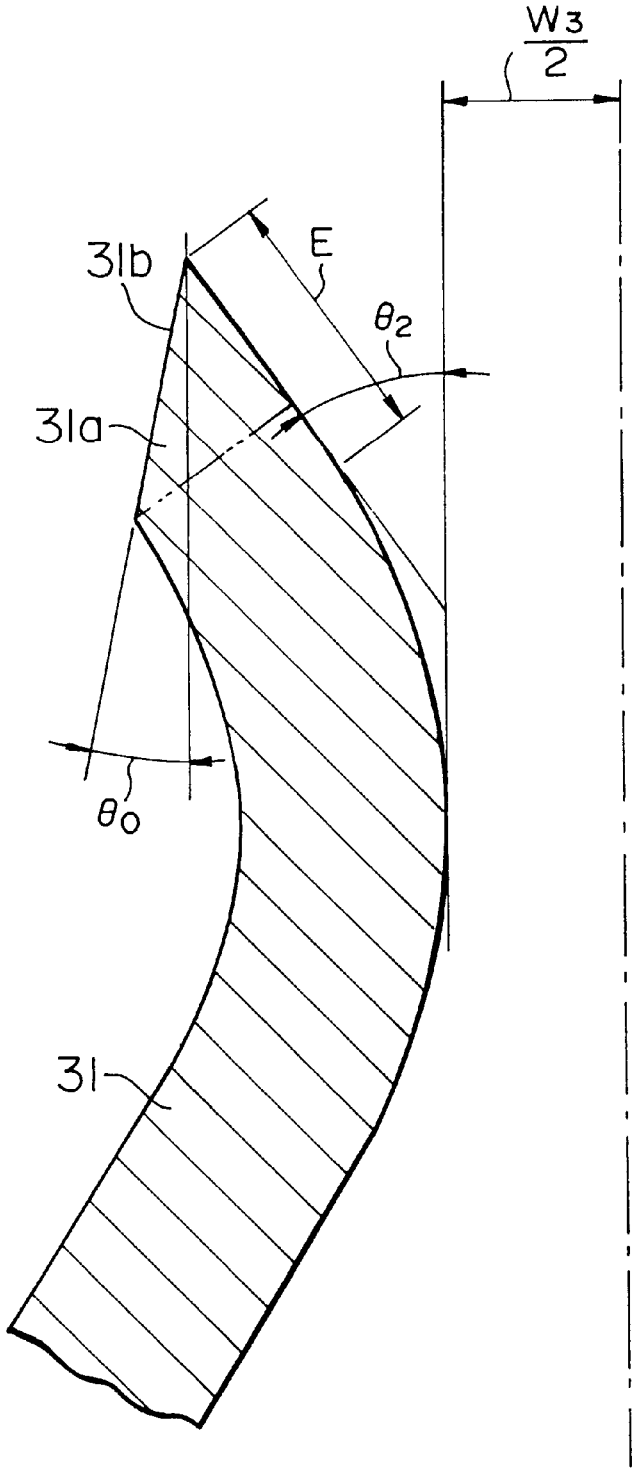
FIG. 7 is a sectional view of the distal end of the female terminal of the present invention.

Referring to FIGS. 5 to 7, the female terminal 21 formed by press punching and press bending an elastic metal plate is inserted and locked in the female terminal insertion window 11*a* of the female connector housing 11 made of a synthetic resin. Similarly, the male terminal 23 is inserted and locked in a male connector housing 12.

Generally, in a high-density connector, the width $W_2$ or $W_2'$ of the female terminal insertion window of the connector housing 11 cannot be set large.

As shown in FIG. 5, when the elastic tongue pieces 31 of the female terminal 21 are displaced, upon insertion of the male terminal 23, substantially perpendicularly to the inserting direction of the male terminal 23, i.e., when the male terminal 23 is moved obliquely at an angle $\theta_1'$ to be inserted and fitted while interfering with an inner wall lie of a male terminal insertion port 11*c* of the female connector housing 11, if an optimum beveling taper angle $\theta_0$ of the beveling tapered-extension portion 31*a* of the elastic tongue piece 31 shown in FIG. 7 (the partial sectional view of the elastic tongue piece 31 of the female terminal 21) is set, from the sizes of the respective portions, to satisfy:

$$\theta_0 = 3/2L\left\{Y_2\tan\theta_1' + \frac{(W_1 - W_3)}{2}\right\} \quad (1)$$

(where $Y_2$ is the distance from the end face of the female terminal insertion window 11*a* of the female connector housing 11 to the constrained portion of the elastic tongue piece 31 of the female connector housing 11, $W_1$ is the opening width of the male terminal insertion port 11*c*, and $W_3$ is the width between the constrained portions of the pair of elastic tongue pieces 31), then the width $W_2'$ of the female terminal insertion window 11*a* can be set at the minimum value without interfering the inner wall 11*b* of the female terminal insertion window 11*a* with the distal-end outer-side surfaces 31*b* of the elastic tongue pieces 31.

At this time, the minimum value of $W_2'$ is determined by the following equation:

$$W_2' \geqq 2\{Y_2 \tan\theta_1' + (Y_2 - Y_1)\tan\theta_3\} + W_1 \quad (2)$$

(where $Y_1$ is the distance from the end face of the female terminal insertion window 11*a* to the proximal end portion of the beveling tapered-extension portion 31*a* of the elastic tongue piece 31 and $\theta_3$ is an angle obtained by adding the angle of deflection of the elastic tongue piece 31 that occurs upon insertion and fitting of the male terminal 23 to a deflection angle $\theta_2$ of the elastic tongue piece 31).

In the conventional case shown in FIGS. 2 and 4, the minimum value of $W_2$ is determined by the following equation:

$$W_2 \geqq 2\{Y_2 \tan\theta_1 + (Y_2 - Y_1)\tan\theta_3 + t\cos\theta_3\} + W_1 \quad (3)$$

Accordingly, when the beveling tapered-extension portions 31*a* are formed at the distal ends of the elastic tongue pieces 31, as in the present invention, the width $W_2'$ of the female terminal insertion window 11*a* can be decreased by $2t\cos\theta_3$. In other words, if $W_2'$ is set equal to that in the conventional case, the width between the two distal ends of the pair of elastic tongue pieces 31, i.e., the width G' of the male terminal receiving port, can be set larger than G of the conventional case by $2t\cos\theta_3$.

In conventional connector design, if the character variables in FIG. 2 are determined as, e.g., $Y_1$=0.3 mm, $Y_2$=0.5 mm, $W_1$=0.5 mm, $W_3$=0.8 mm, $\theta_1$=15.7°, $\theta_2$=32.6°, $\theta_3$=42.3°, L=2.64 mm, and t=0.2 mm (where L is the spring length of the elastic tongue piece 31 and t is the thickness of the elastic tongue piece 31), then the width $W_2$ of the female terminal insertion window inner wall 11*b* of the conventional female connector housing 11 satisfies $W_2$=2.78 mm.

In a high-density connector, it is necessary that the width $W_2$ or $W_2'$ of the female terminal insertion window 11*a* of the female connector housing 11 be as small as possible. If the taper angle $\theta_0$ of the beveling tapered-extension portion 31*a* of the elastic tongue piece 31 is designed to satisfy $\theta_0$=1.12°, as in the present invention, $W_2'$ satisfies $W_2'$=2.34 mm and the pitch of the connector terminals can be decreased by $W_2 - W_2'$=0.44 mm (decreased by 16% the pitch of the conventional case)

and a higher-density connector is realized.

Figure 3:
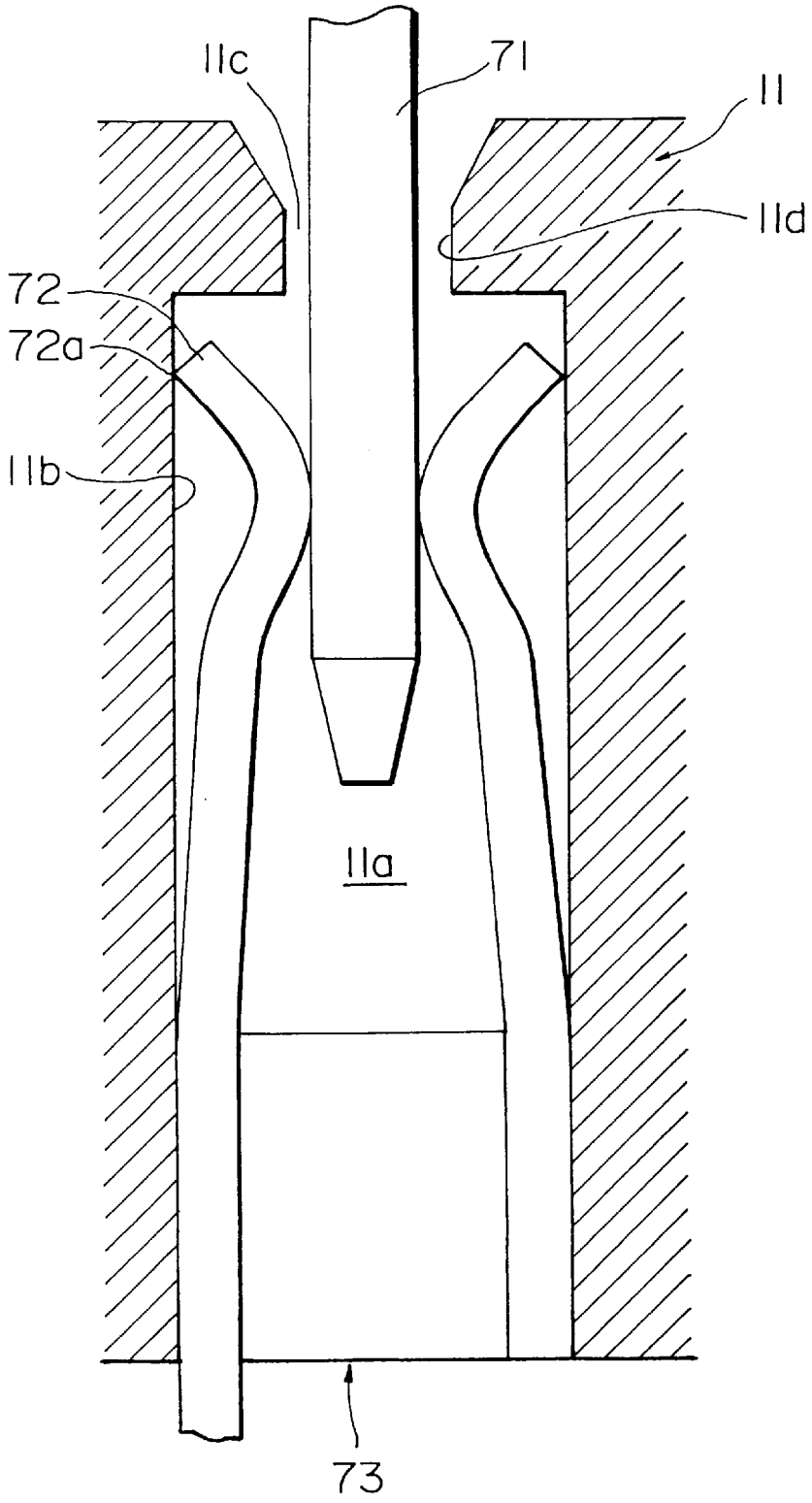
FIG. 3 PRIOR ART

Referring to FIGS. 2 to 4 showing the fitting state of the male terminal 71 and the elastic tongue pieces 72 of the female terminal 73 of the conventional case, when downsizing the connector, it is preferable that a depth C of the male terminal insertion port 11*c* be decreased as much as possible. Since the allowable fluctuation of the male terminal 71 is defined by a depth X of the male terminal insertion port 11*c* excluding the tapered portion 11*e*, to allow the male terminal 71 to be reliably received by the elastic tongue pieces 72, the width G of the male terminal receiving port of the female terminal 73 with respect to the fluctuation of the male terminal 71 must satisfy the following inequality:

$$G \geq 2Y_1\tan\theta_1 + W_1 - \frac{2D\tan\theta_4}{\cos\theta_1} \quad (4)$$

The correlation with the depth X is:

$$\cos\theta_1 = \frac{W_1 X + \sqrt{W_1^2 t_1^2 - (W_1^2 + X^2)(t_1^2 - X^2)}}{W_1^2 + X^2} \quad (5)$$

In FIG. 2, if a length A of the connector housing 11 is to be further decreased in order to downsize the connector, the depth C of the male terminal insertion port 11*c*, i.e., the depth X of the male terminal insertion port 11*c* excluding the tapered portion 11*e*, may be designed small. In this case, however, the fluctuation of the male terminal 71 increases, and with the conventional design, the male terminal 71 cannot be received by the male terminal receiving port of the female terminal 73. Therefore, the depth X at which the equality is established in the above inequality (5) is the minimum value.

To further decrease the depth X, the design according to the present invention is practiced. When the beveling tapered-extension portions 31*a* are formed at the distal ends of the elastic tongue pieces 31, the width G of the male terminal receiving port of the female terminal 21 can be increased to G' without changing the position of contact of the female terminal 21 and the width $W_2'$ of the female terminal insertion window. At this time, G' satisfies:

$$G' = 2\left\{Y_1 - \frac{t\cdot\cos\theta_2}{\tan(\theta_0 + \theta_2)}\right\}\tan\theta_1' + W_1 - \frac{2D\cdot\tan\theta_4}{\cos\theta_1'} + \frac{2t\cdot\sin\theta_2}{\tan(\theta_0 + \theta_2)}$$

Therefore, the allowable value of the maximum fluctuation of the male terminal 23 increases, and accordingly, the depth X can be designed further small, and the length A of the connector housing 11 can be designed smaller.

What I claim is:

1. A contact comprising:

a bifoliate female terminal, having a pair of elastic tongue pieces with distal end portions adapted to come into contact and fit with a rod-like male terminal, said elastic tongue pieces inserted and locked in a female terminal insertion window in a female connector housing made of an insulator and having a male terminal insertion port having a tapered portion at an inlet port thereof and said female terminal insertion window located on a side opposite to said male terminal insertion port and having a larger opening width than that of said male terminal insertion port, wherein said distal end portions of said elastic tongue pieces are formed with beveling tapered-extension portions terminating with first and second surfaces connected at an acute angle such that, when said elastic tongue pieces are displaced substantially perpendicularly to an inserting direction of said rod-like male terminal upon insertion and fitting of said rod-like male terminal between said pair of elastic tongue pieces of said bifoliate female terminal, distal-end outer-side surfaces of said elastic tongue pieces become parallel to an inner wall of said female terminal insertion window with an angle determined by considering an angle of deflection of said elastic tongue pieces, wherein said distal end portions of said elastic tongue pieces of said bifoliate female terminal housed and locked in said female terminal insertion window of said female connector housing by press fitting, and a distal-end contact portion of said rod-like male terminal pressed into and locked by an end face of said male connector housing made of said insulator into a box shape are electrically and mechanically connected to each other by fitting a female connector having said female connector housing and said bifoliate female terminal, and a male connector having said male connector housing and said rod-like male terminal, with each other, said female connector and said male connector respectively having terminal portions connected to through holes formed in printed circuit boards by soldering or press fitting of elastic plastic contact portions, thereby allowing the printed circuit boards to be electrically connected to each other, and wherein when an insertion angle $\theta_1'$ at which said rod-like male terminal is inserted in said female terminal insertion window through said male terminal insertion port of said female connector housing becomes the maximum, a width G' of a male terminal receiving port corresponding to a distance between distal ends of two beveling tapered-extension portions of said pair of elastic tongue pieces satisfies a following correlation:

$$G' = 2\left\{Y_1 - \frac{t \cdot \cos\theta_2}{\tan(\theta_0 + \theta_2)}\right\}\tan\theta_1' + W_1 - \frac{2D \cdot \tan\theta_4}{\cos\theta_1'} + \frac{2t \cdot \sin\theta_2}{\tan(\theta_0 + \theta_2)}$$

where $Y_1$ is a distance from an end face of said female terminal insertion window to said distal ends of said elastic tongue pieces of said female terminal, t is a thickness of said elastic tongue pieces, $W_1$ is a width of said male terminal insertion port, D is a length of a tapered portion of a distal end portion of said rod-like male terminal, X is a death of said male terminal insertion port, $\theta_0$ is a taper angle of each of said beveling tapered-extension portions of said elastic tongue pieces, $\theta_1'$ is the insertion angle at which said rod-like male terminal is inserted in said female terminal insertion window through said male terminal insertion port, $\theta_2$ is an angle of deflection of each of said distal end portions of said elastic tongue pieces, and $\theta_4$ is a taper angle of said distal end portion of said rod-like male terminal.

2. The contact of claim 1, wherein the correlation with the depth X is:

$$\cos\theta_1' = \frac{W_1 X + \sqrt{W_1^2 t_1^2 - (W_1^2 + X^2)(t_1^2 - X^2)}}{W_1^2 + X^2}$$

wherein $t_1$ is the thickness of the male terminal.

* * * * *